US008766069B2

(12) United States Patent
Bisheimer

(10) Patent No.: US 8,766,069 B2
(45) Date of Patent: Jul. 1, 2014

(54) DEVICE FOR FACILITATING STRINGING OF A MUSICAL INSTRUMENT

(76) Inventor: Michael Bisheimer, Golden, CO (US)

( * ) Notice: Subject to any disclaimer, the term of this patent is extended or adjusted under 35 U.S.C. 154(b) by 51 days.

(21) Appl. No.: 13/474,478

(22) Filed: May 17, 2012

(65) Prior Publication Data

US 2012/0285313 A1 Nov. 15, 2012

Related U.S. Application Data

(63) Continuation-in-part of application No. 12/917,225, filed on Nov. 1, 2010, now Pat. No. 8,466,360.

(60) Provisional application No. 61/284,988, filed on Dec. 31, 2009.

(51) Int. Cl.
*G10D 3/12* (2006.01)

(52) U.S. Cl.
CPC ..... *G10D 3/12* (2013.01)
USPC ..... 84/297 R; 84/267; 84/291

(58) Field of Classification Search
CPC ..... G10D 3/12
USPC ..... 84/297 R, 291, 267
See application file for complete search history.

(56) References Cited

U.S. PATENT DOCUMENTS

| | | | | | |
|---|---|---|---|---|---|
| D33,685 | S | * | 12/1900 | Behee | D17/19 |
| 881,269 | A | | 3/1908 | Van Houton | |
| 2,492,845 | A | * | 12/1949 | Conkling et al. | 84/314 R |
| D170,109 | S | * | 8/1953 | Bigsby | D17/21 |
| 3,834,266 | A | * | 9/1974 | Robinson | 84/267 |
| 3,901,293 | A | | 8/1975 | Cottone | |
| 4,138,919 | A | | 2/1979 | Miller | |
| 4,359,923 | A | * | 11/1982 | Brunet | 84/267 |
| 4,359,924 | A | * | 11/1982 | Brunet | 84/293 |
| 4,611,523 | A | | 9/1986 | Mcfarland | |
| 4,890,529 | A | * | 1/1990 | Grant | 84/291 |
| 6,107,556 | A | | 8/2000 | Gilliam | |
| 6,489,548 | B1 | | 12/2002 | Schindler | |
| D560,709 | S | * | 1/2008 | Unkert | D17/20 |
| 8,071,868 | B2 | * | 12/2011 | Dennis | 84/313 |
| 8,163,987 | B1 | * | 4/2012 | Dennis | 84/313 |
| 8,466,360 | B2 | * | 6/2013 | Bisheimer | 84/297 R |
| 2002/0038596 | A1 | | 4/2002 | Lome | |
| 2003/0037663 | A1 | | 2/2003 | Hamilton | |
| 2007/0012157 | A1 | | 1/2007 | D'Addario | |
| 2011/0154972 | A1 | | 6/2011 | Bisheimer | |
| 2012/0285313 | A1 | * | 11/2012 | Bisheimer | 84/298 |

OTHER PUBLICATIONS

"Vibramate—Guitarist—Spoiler Review!" Vibramate® Music Products, 2008, printed Sep. 15, 2011 from http://www.vibramate.com/guitarist-spoiler.php, 3 pages.

(Continued)

*Primary Examiner* — Robert W Horn
(74) *Attorney, Agent, or Firm* — Sheridan Ross P.C.

(57) ABSTRACT

A device for facilitating the stringing of a guitar is provided. More specifically, a device is provided that includes a head portion with at least one member for contacting and maintaining a first end of a guitar string around a cylindrical axle of a guitar bridge while the other end of the string is being interconnected to the tuning pegs of the instrument. Thus, the tool facilitates the stringing of a guitar by, for example, allowing the use of both hands to interconnect a second end of the guitar string to the tuning peg.

14 Claims, 14 Drawing Sheets

(56) References Cited

OTHER PUBLICATIONS

"Vibramate String Spoiler™," Vibramate® Music Products, 2008, printed Sep. 15, 2011 from http://www.vibramate.com/vibramate-string-spoiler.php, 3 pages.

Official Action for U.S. Appl. No. 12/917,225, mailed Sep. 13, 2012 7 pages.

Notice of Allowance for U.S. Appl. No. 12/917,225 mailed Feb. 21, 2013, 7 pages.

* cited by examiner

DEVICE FOR FACILITATING STRINGING OF A MUSICAL INSTRUMENT

This application is a continuation-in-part of U.S. patent application Ser. No. 12/917,225, filed Nov. 1, 2010, which claims the benefit of U.S. Provisional Patent Application Ser. No. 61/284,988, filed Dec. 31, 2009, the entire disclosures of which are incorporated by reference herein.

FIELD OF THE INVENTION

Embodiments of the present invention are generally related to stringing or restringing of a musical instrument, and more particularly to stringing guitars that employ tremolos or floating bridges. One embodiment of the present invention is a device that is selectively associated with components of the bridge that facilitates stringing or restringing.

BACKGROUND OF THE INVENTION

Some musical instruments such as a bass, a viola, a violin, a guitar and other "string instruments" employ a plurality of strings that when contacted by a bow, plucked, strummed or otherwise contacted vibrate to create a particular musical note or notes. The nature of the musical notes produced by the vibrating strings is dependent on the string material, composition, thickness, tension, etc., which is understood by those of skill in the art. Continued use of the musical instrument will eventually cause the strings to slacken, elongate, or otherwise deform, thereby detrimentally altering the notes produced thereby. To address this effect, tuning pegs are used to selectively tighten and slacken a given string in an attempt to achieve a desired performance. Over time, however, selective tuning measures will become less effective or will not work and the musical instrument will need to be restrung. Stringing and restringing a musical instrument is difficult, frustrating, and time consuming.

Guitars tend to require frequent restringing because of the vigorous way they are often played. The strings of a guitar vary from 0.008 inches to 0.05 inches in diameter and are made of a metallic material, such as nickel, bronze or stainless steel wire. Due to the inherent ductility of the string material, strings will tend to elongate over time, thereby altering their vibrational characteristics. Accordingly, professional guitar players often need to resting their guitar prior to each show.

Some guitar bridges include an axle that receives a first end of a guitar string. The first end of the guitar string employs an axle interconnection member, such as a spool or a ball, that selectively engages a pin or recess or other gripping device associated with the axle. In operation, one engages the guitar string spool onto the axle, wraps the string around the axle, and interconnects a second end of the string to a tuning peg located on a headstock portion of the guitar. As those skilled in the art will appreciate, such a process is difficult in that the new strings are somewhat inflexible and, thus, resistant to curling around the axle. More specifically, when the user does not hold the new string in place while interconnecting the second end to the tuning peg, the first end of the string will tend to recoil which disengages the spool from the axle. Often, individuals do not have sufficient dexterity and/or arm length to hold the first end of the guitar string against the axle to prevent recoil while interconnecting the second end to the tuning peg. Thus guitar stringing is often frustrating and time consuming.

Thus, it is a long felt need to provide a device that facilitates the stringing of a musical instrument that will aid expert guitar stringers and novices alike. The following disclosure describes a device that maintains the engagement of the first end of a guitar string with the bridge, thereby freeing an individual's hands to interconnect the second end of the string to the tuning peg.

SUMMARY OF THE INVENTION

It is one aspect of the present invention to provide a device for facilitating the stringing of a musical instrument, such as a guitar. More specifically, one embodiment of the present invention is a device that includes a portion for sliding beneath an axle of a guitar bridge. Another portion of the device engages a first end of a guitar string and maintains the string's engagement to the axle while a second end of the guitar string is interconnected to a tuning peg positioned some distance away from the bridge.

As briefly mentioned above, a guitar stringing is an often complex and frustrating process. In operation, one must engage the first end of a string, which includes a ball or spool, onto the axle. The axle receives the spool within a cavity, on a pin, or other mechanism known in the art. The string is then wound under and at least partially around the axle wherein a second end of the guitar string is directed to the tuning peg and fastened thereto. As the second end of the guitar string is being interconnected to the tuning peg, it will tend to recoil and disengage from the axle. This phenomena is most apparent in new guitar strings that are relatively stiff. Currently, an individual holds the first end of the guitar string with one hand and engage the other second end to the tuning peg with their other hand, which is difficult to achieve. Embodiments of the present invention maintain the first end of the guitar string against the axle in a hands-free manner, thereby allowing the individual to use both hands to engage the second end of the guitar string to the tuning peg without having to worry about first end being disengaged. Thus, the speed and precision of stringing a guitar is vastly increased.

It is yet another aspect of the present invention to provide a device that engages multiple guitar strings simultaneously. More specifically, embodiments of the present invention include a spool retaining portion that is adapted to maintain at least one guitar string spool around an axle. Other embodiments of the present invention, however, possess an elongated spool retaining portion that accommodates more than one guitar string. Thus the first ends of all guitar strings may be securely associated with the axle such that the second ends of those strings can be interconnected to their respective tuning pegs.

It is another aspect of the present invention to provide a device for facilitating the stringing of a guitar that is easy to use. More specifically, the bridges, i.e., and/or tremolos, found on a great majority of electric guitars, are generally of a standard manufacture. Thus, embodiments of the present invention are made to fit the majority of guitars which will be understood by those skilled in the art upon review of the detailed description below. One embodiment of the present invention includes an ergonomic handle that facilitates placement of a channel, which is associated with the spool retaining portion of the device, beneath the axle. As the handle is rotated to a position adjacent to the bridge, the spool retaining portion will firmly secure the spools against the axle. Other embodiments of the present invention include a selectively deflectable string-maintaining tab that is engaged by a user's thumb, for example, that contacts a wound portion of the strings positioned about the outer side of the axle. Once the device is placed in such a way to engage the first end of the guitar string, it remains in place such that no further user contact is required. Removal of the tool is achieved by lifting the handle and rotating it away from the axle, which moves the spool retaining portion away from the spool and the axle.

It is another aspect of the present invention to provide a device for facilitating the stringing of a guitar that is made of inexpensive and easy to mold materials. More specifically, one embodiment of the present invention is made of injection molded nylon. Those skilled in the art, however, will appreciate that other materials, such as aluminum, steel, carbon fiber, plastics, etc. may be used without departing from the scope of the invention. It is a related aspect of the present invention to provide a device that is small and easily stored. One embodiment of the present invention is made of a lightweight nylon material that is rigid and easily stored within a guitar case, for example. Other embodiments of the present invention are hinged or otherwise foldable to reduce the storage volume.

It is one embodiment of the present invention to provide a device for facilitating stringing of a musical instrument, comprising: a handle; a U-shaped head having a first portion interconnected to the handle and a second portion spaced therefrom that is adapted for engagement with at least one guitar string; and wherein head is adapted to be placed under an axle of a guitar bridge with the second portion adapted to maintain the guitar string onto the axle.

It is another aspect of the present invention to provide a device for facilitating stringing of a musical instrument, comprising: a head having a first portion and a second portion spaced therefrom that is adapted for engagement with a first end of at least one string of the musical instrument.

It is another aspect of the present invention to provide a method for restringing a guitar having a bridge and a tuning peg comprising: providing a device having a string retaining portion spaced from a second portion that defines a channel therebetween, the second portion being interconnected to a handle; wrapping a guitar string about an axle of the bridge; engaging a portion of the string onto the axle; positioning the tool under the axle such that the string retaining portion engages a portion of the string to maintain the same in engagement with the axle; engaging a second end of the string onto the tuning peg.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
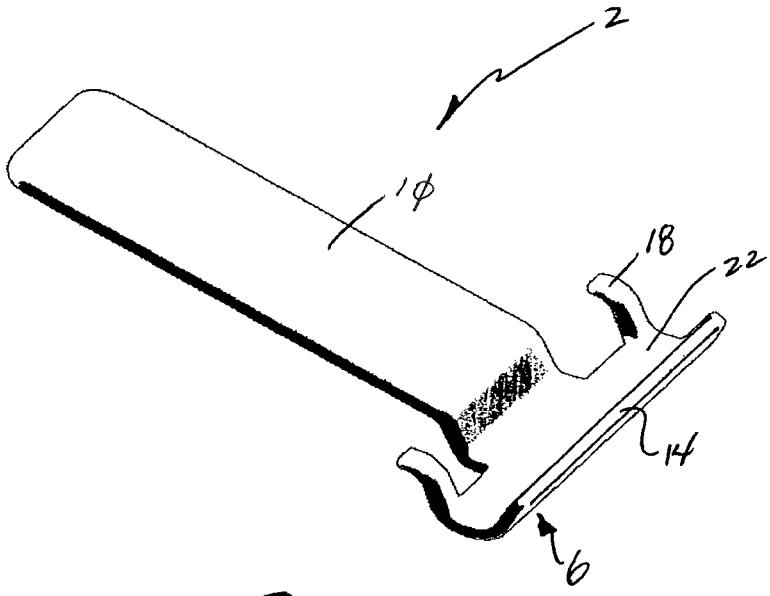
FIG. 1 is a perspective view of a string retaining device of one embodiment of the present invention.

To assist in the understanding of one embodiment of the present invention the following list of components and associated numbering found in the drawings is provided herein:

| # | Components |
|---|---|
| 2 | String retaining device |
| 6 | Head |
| 10 | Handle |
| 14 | Spool retaining portion |
| 18 | Finger |
| 22 | Channel |
| 30 | Axle |
| 34 | String |
| 42 | Bridge |
| 46 | Spool |
| 50 | Tab |
| 54 | Bar |
| 58 | Protrusion |
| 62 | Lateral finger |
| 66 | Upper ridge |
| 70 | Lower ridge |
| 74 | Gussett |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to FIGS. 1-16 a string retaining device 2 is provided. The string retaining device 2 of some embodiments of the present invention employs a head 6 that is interconnected to a handle 10. The head 6 also possesses a spool retaining portion 14 spaced from at least one finger 18 with a channel 22 positioned therebetween. Some embodiments of the present invention include a movable tab 50 that facilitates engagement of the string retaining device 2 onto a bridge axle 30 and that helps hold the guitar strings 34 against the axle 30.

Figure 2:
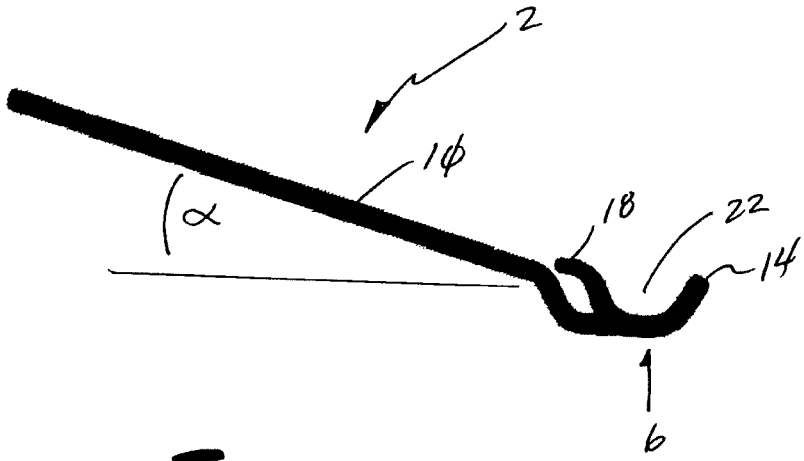
FIG. 2 is a side elevation view of FIG. 1.
Figure 3:
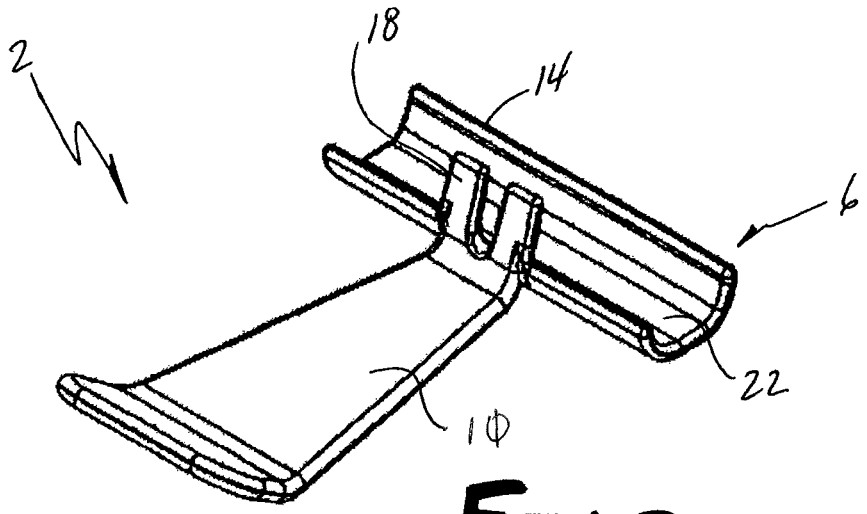
FIG. 3 is a rear perspective view of a string retaining device of another embodiment of the present invention.
Figure 4:
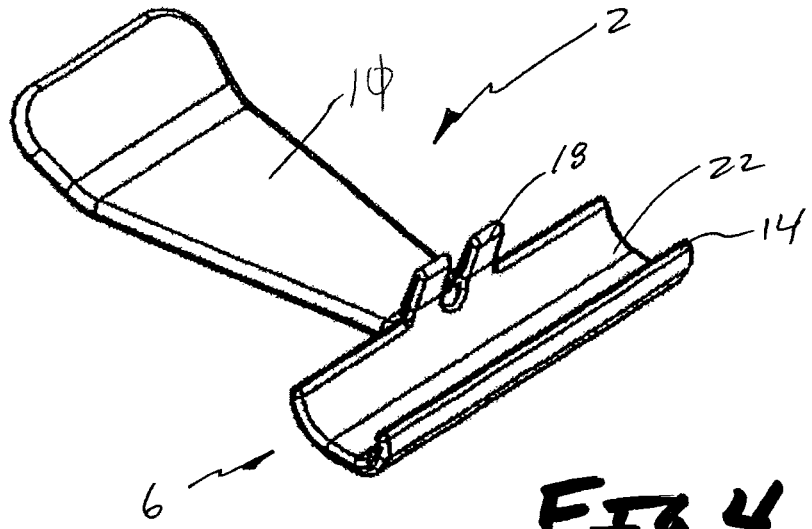
FIG. 4 is a front perspective view of a string retaining device of FIG. 3.
Figure 5:
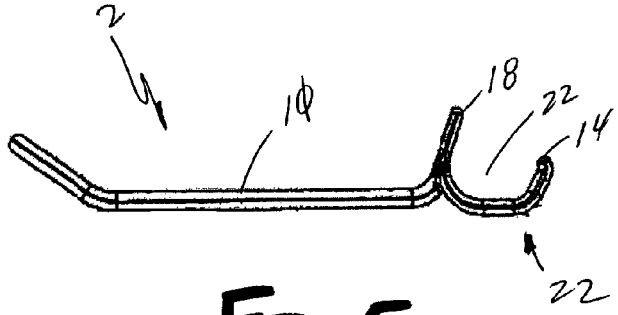
FIG. 5 is a side elevation view of the embodiment of FIG. 3.

Referring now specifically to FIGS. 1 and 2, the string retaining device 2 is shown that includes the handle 10 and is interconnected to the head 6. The handle 10 may be interconnected to the head 6 at an angle (a) that facilitates placement of the channel 22 under the axle, which will be further understood upon review of FIG. 7, for example. Once the head 6 is placed under the axle, the handle 10 is rotated toward the guitar which pivots the spool retaining portion 14 to a position of engagement with the spool of at least one guitar string.

FIGS. 3-8 show another embodiment of the present invention that employs a handle 10 having an end that is angled. This embodiment of the present invention also includes at least one finger 18 that is associated with the head 6 and positioned opposite from the spool retaining portion 14 thereof. The angled handle facilitates rotation of the spool retaining portion into place.

Figure 6:
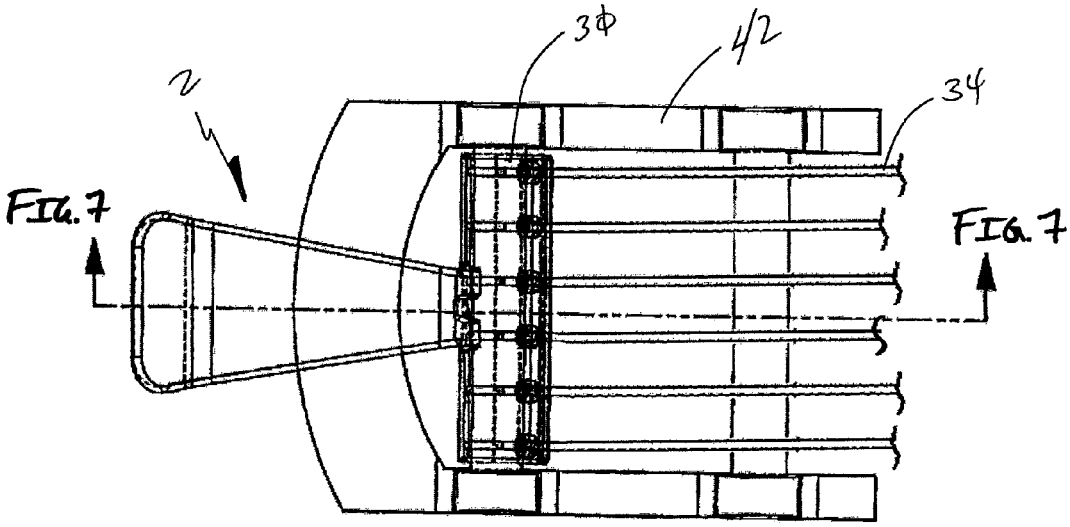
FIG. 6 is a top plan view of the embodiment of FIG. 3 shown interconnected to an axle of a guitar bridge.
Figure 7:
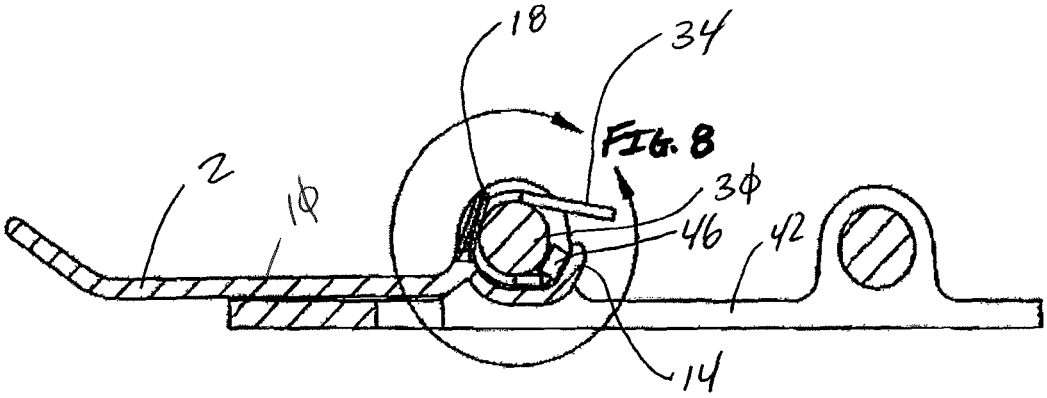
FIG. 7 is a cross-sectional view of FIG. 6.
Figure 8:
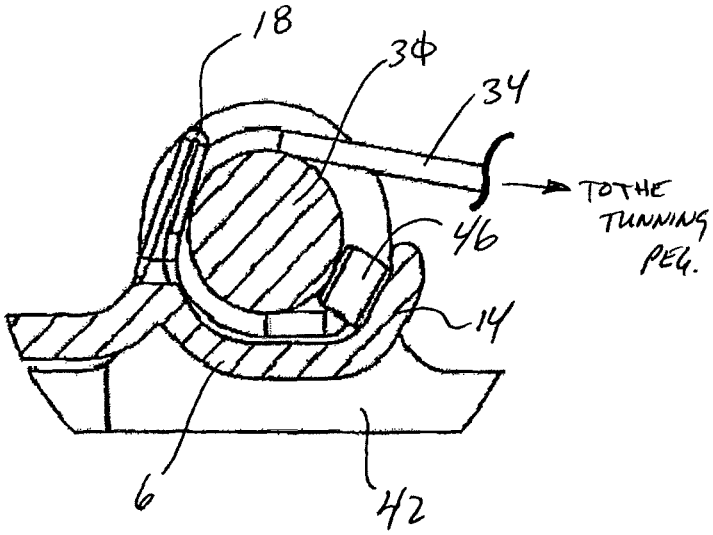
FIG. 8 is a detail view of FIG. 7.

Referring now specifically to FIGS. 6-8, the engagement of the string retaining device 2 on to a bridge 42 is shown. Here, the guitar string spools 46 are engaged onto or otherwise associated with the bridge 30. The string 34 is then wrapped around the axle 30 and directed towards the tuning pegs (not shown), which are positioned a distance from the axle 30. Next, the head 6 is placed under the axle 30 and associated strings 34 wherein the axle 30 and associated string ends are at least partially received within the channel 22 of the head 6. Next, the handle 10 is rotated adjacent to the bridge 42 as shown in FIG. 7, which positions the spool retaining portion 14 adjacent to the spools 46 associated with the guitar strings 34 to maintain them on the axle 30. The optional fingers 18 engage a wound portion of the string 34 to maintain the string 34 against the axle 30 and to help prevent string recoil. After a second ends of the guitar strings are interconnected to their respective tuning pegs, the handle 10 is rotated away from the bridge 42, thereby removing the spool retaining portion 14 from the spools 46 which allows the string retaining device 2 to be removed from the bridge 42.

Figure 9:
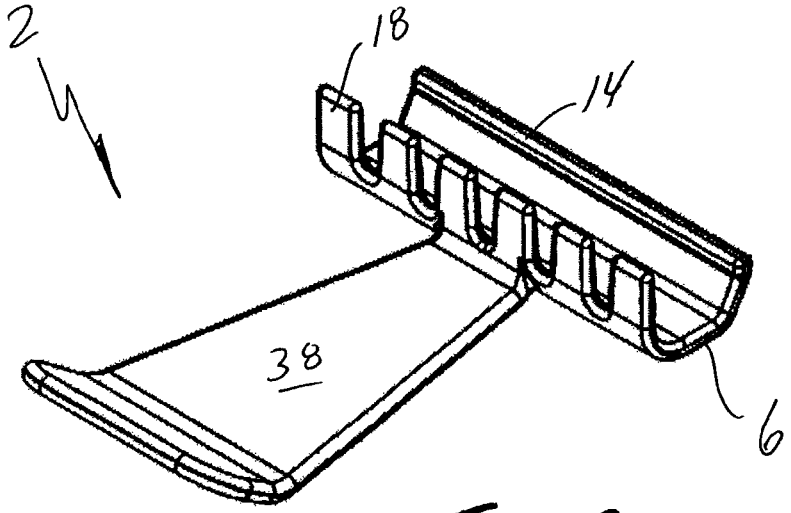
FIG. 9 is a rear perspective view of a string retaining device of another embodiment of the present invention.
Figure 10:
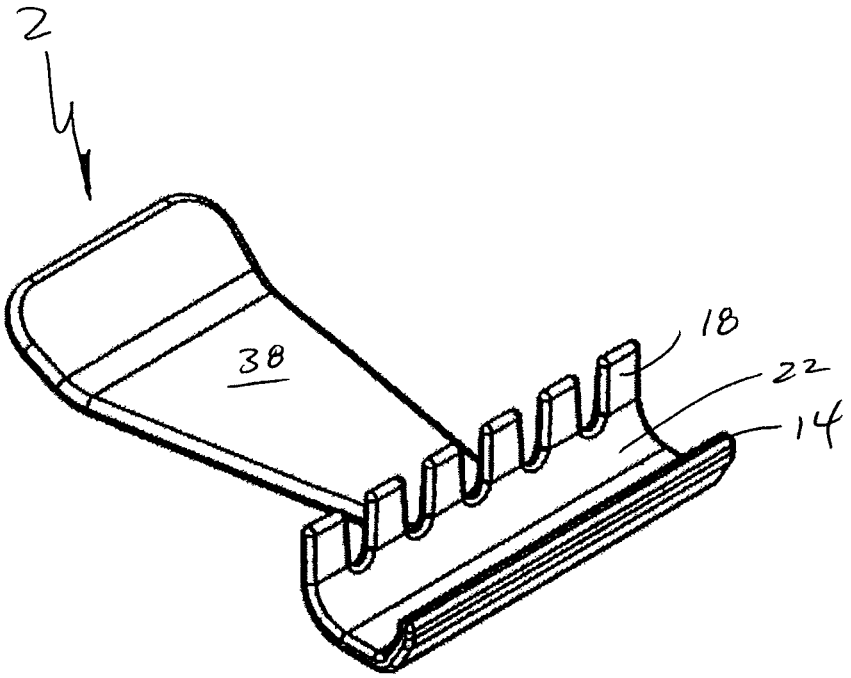
FIG. 10 is a front perspective view of FIG. 10.
Figure 11:
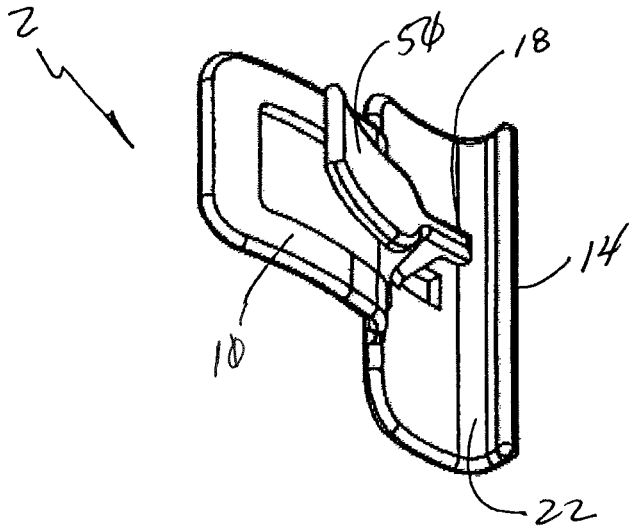
FIG. 11 is a perspective view of a string retaining device of another embodiment of the present invention.
Figure 12:
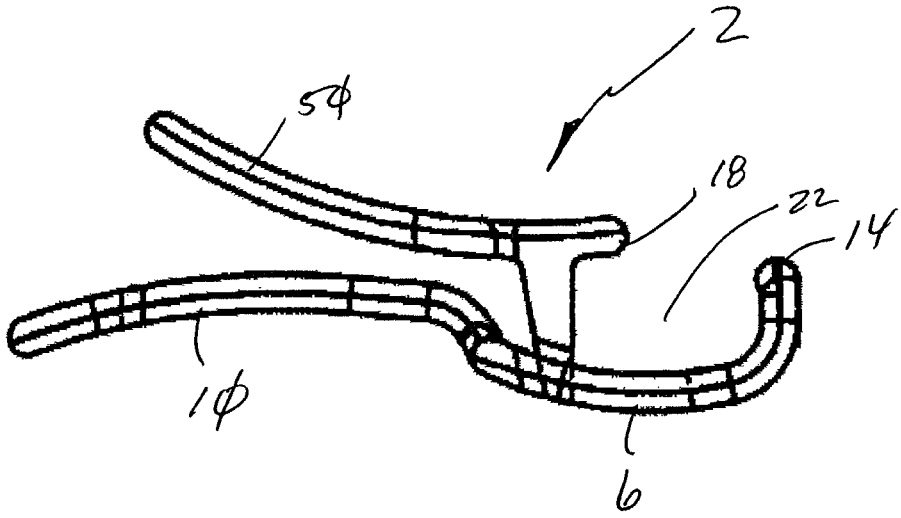
FIG. 12 is a side elevation view of the embodiment shown in FIG. 11.
Figure 13:
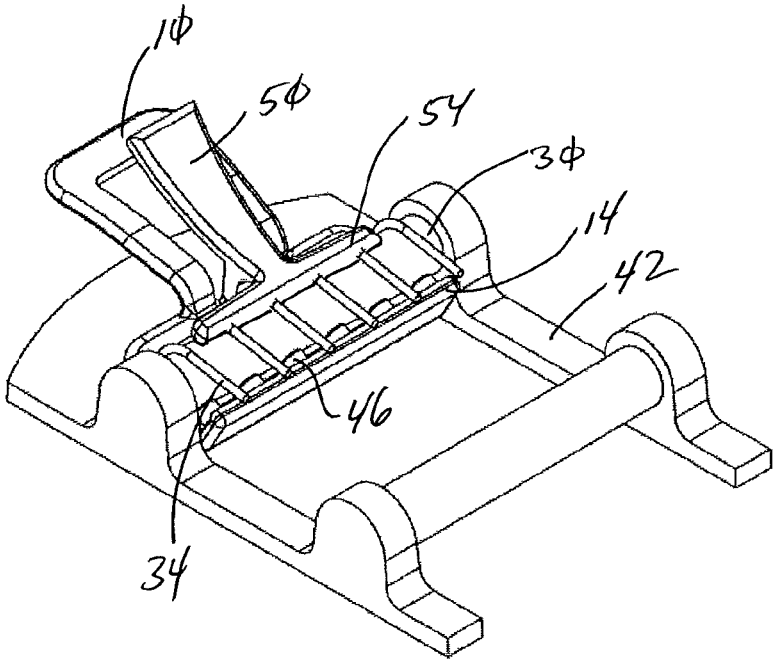
FIG. 13 is a perspective view of a string retaining device of another embodiment of the present invention shown interconnected to the axle of a guitar bridge.
Figure 14:
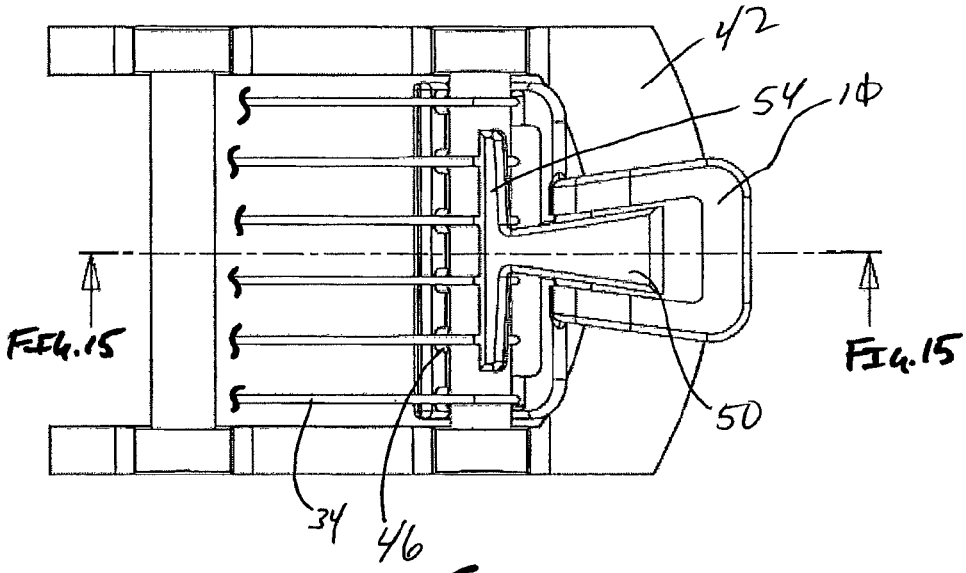
FIG. 14 is a top plan view of FIG. 13.
Figure 15:
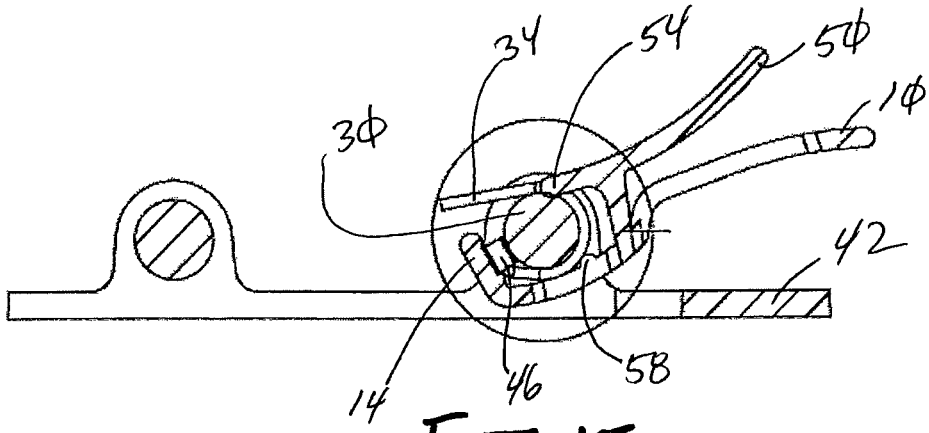
FIG. 15 is a cross-sectional view of FIG. 14.
Figure 16:
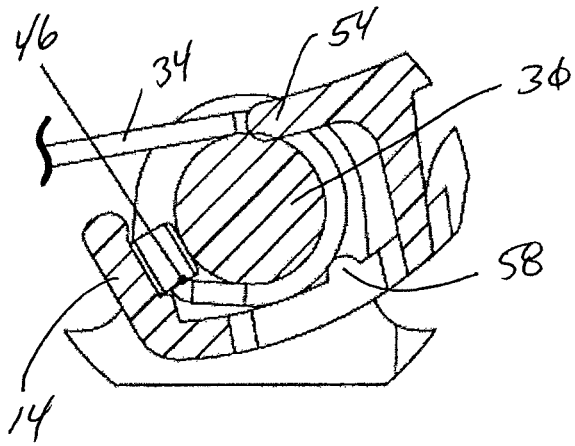
FIG. 16 is a detail view of FIG. 15.

Referring now to FIGS. 9 and 10, another embodiment of the present invention is shown that includes a plurality of fingers 18. Here, six fingers are provided, which correspond to the strings of a six-string guitar. The fingers 18 aid in maintaining the string in a wound configuration around the axle. In addition, the fingers 18 help guide placement of the device 2 on the axle. The fingers 18 may be omitted. In addition, those skilled in the art will appreciate that the fingers 18 may be selectively made frangible such that at least one or more of the fingers 18 may be removed if they are not desired. The fingers may include indicia or colors to indicate the proper strings that should be associated with a particular location on the axle to help ensure correct string interconnection.

Referring now to FIGS. 11-16, another embodiment of the present invention is provided that includes a selectively deflectable tab 50. The tab 50 is associated with a portion of the head opposite from the spool retaining portion 14 and is selectively interconnected thereto by a hinge, for example, a living hinge. At least one finger 18, as described above, may be associated with the tab 50. This embodiment of the present invention facilitates engagement of the string retaining device 2 onto the axle 30 as the fingers 18 are able to be selectively deflected away from the spool retaining portion 14, thereby widening the channel 22 so that the axle 30 is received more easily.

Referring now specifically to FIGS. 13-16, a similar embodiment is shown that includes a selectively deflectable tab 50 with a bar 54 that engages a plurality of strings. This embodiment of the present invention functions similar to that shown in FIG. 11 such that deflection of the tab 54 towards the handle 10 will widen the channel 22 to facilitate receipt of the axle 30. At least one protrusion 58 is disposed in the channel 22 that is adapted to engage another portion of the string to further prevent recoil. One skilled in the art will appreciate that such protrusions or other holding mechanism may be included in any of the embodiments described herein.

Figure 17:
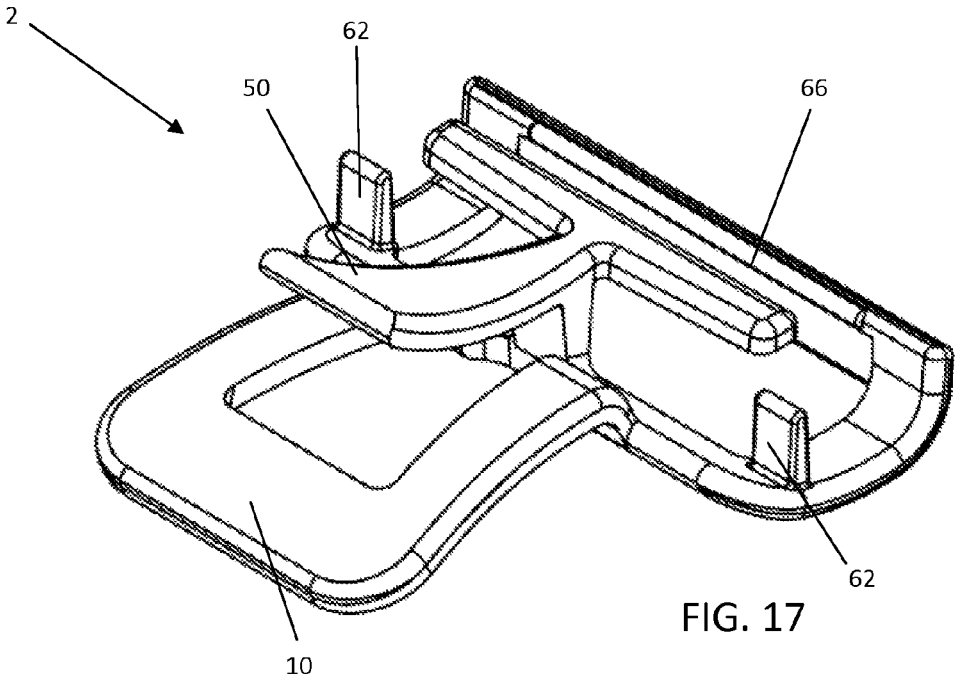
FIG. 17 is a perspective view of a string retaining device of another embodiment of the present invention.
Figure 18:
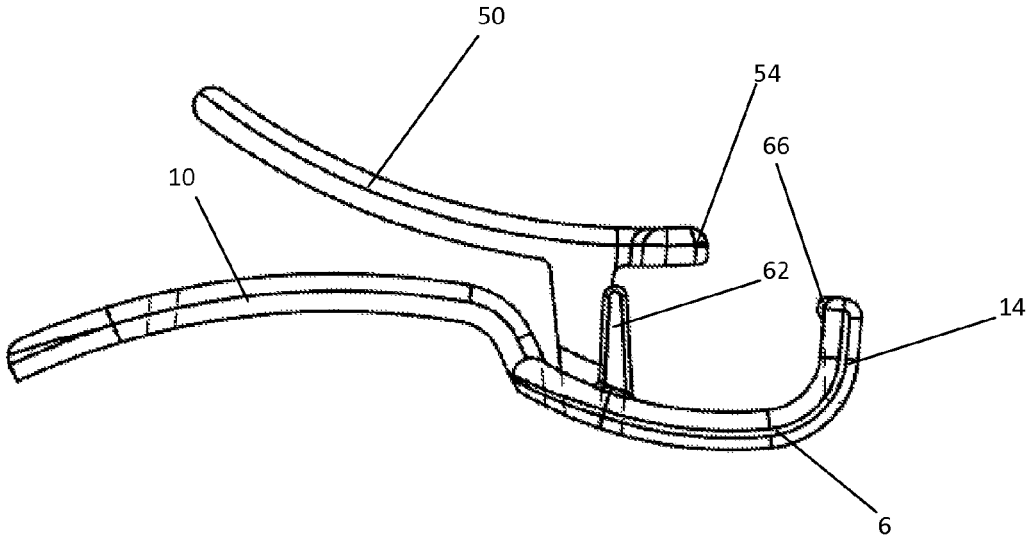
FIG. 18 is a side elevation view of the embodiment shown in FIG. 17.
Figure 19:
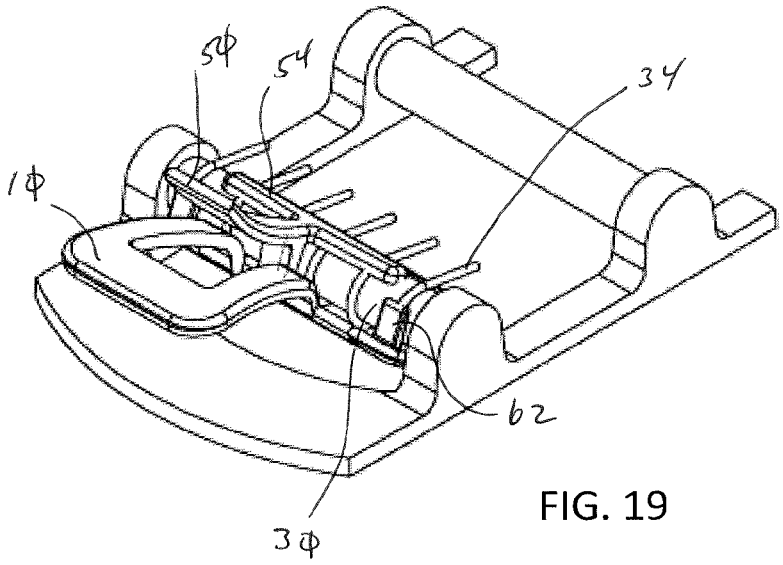
FIG. 19 is a perspective view of the string retaining device of FIG. 17 shown interconnected to the axle of a guitar bridge.

FIGS. 17-19 show a string retaining device 2 of yet another embodiment of the present invention that is comprised of elements similar to those described above. More specifically, the string retaining device 2 includes a handle 10 interconnected to a head 6 that includes a spool retaining portion 14. The device 2 also includes a tab 50 that selectively moves a bar 54 when pressure is applied in a direction towards the handle 10. In addition, lateral fingers 62 similar to that described above with respect to FIGS. 3 and 4, for example. The lateral fingers 62 are interconnected to the head 6 adjacent to its outer edge. The lateral fingers 62 help align the device 2 while restraining the outermost guitar strings as shown in FIG. 19. The lateral tabs 62 also help ensure that no portion of the chrome on the axle is contacted. As one of skill in the art will appreciate, many of the embodiments of the present invention discussed herein possess features or of a shape that limits or prevents contact with the axle and other finished portions of the guitar, which is very desirous. For example, it is a goal of one embodiment of the present invention to provide a string retaining device that does not contact the axle or any finished portions of a Bigsby® tremelo, wherein only the guitar string and associated spool or pin are contacted.

Furthermore, the spool retaining portion of this embodiment of the present invention includes a spool retaining portion 14 that terminates in an enlarged upper ridge 66, which is shown in FIG. 17, for example. The upper ridge 66 grips the top portion of the spool provides additional holding force to the spool (see FIG. 22). The spool retaining portion of one embodiment has a radius of about 0.030 inches.

Figure 20:
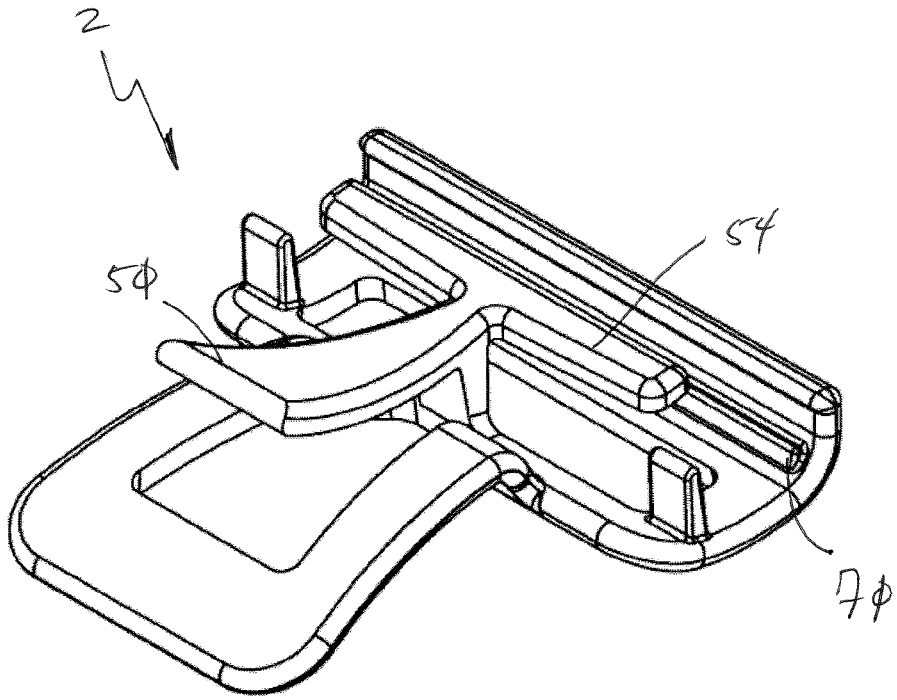
FIG. 20 is a perspective view of a string retaining device of another embodiment of the present invention.
Figure 21:
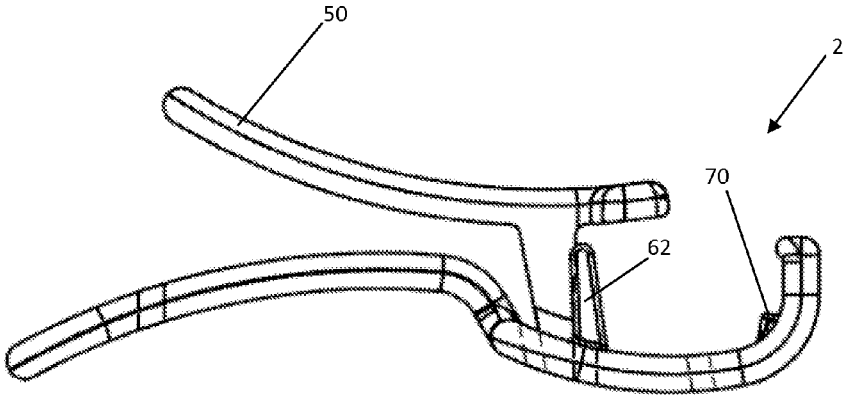
FIG. 21 is a side elevation view of the embodiment shown in FIG. 20.
Figure 22:
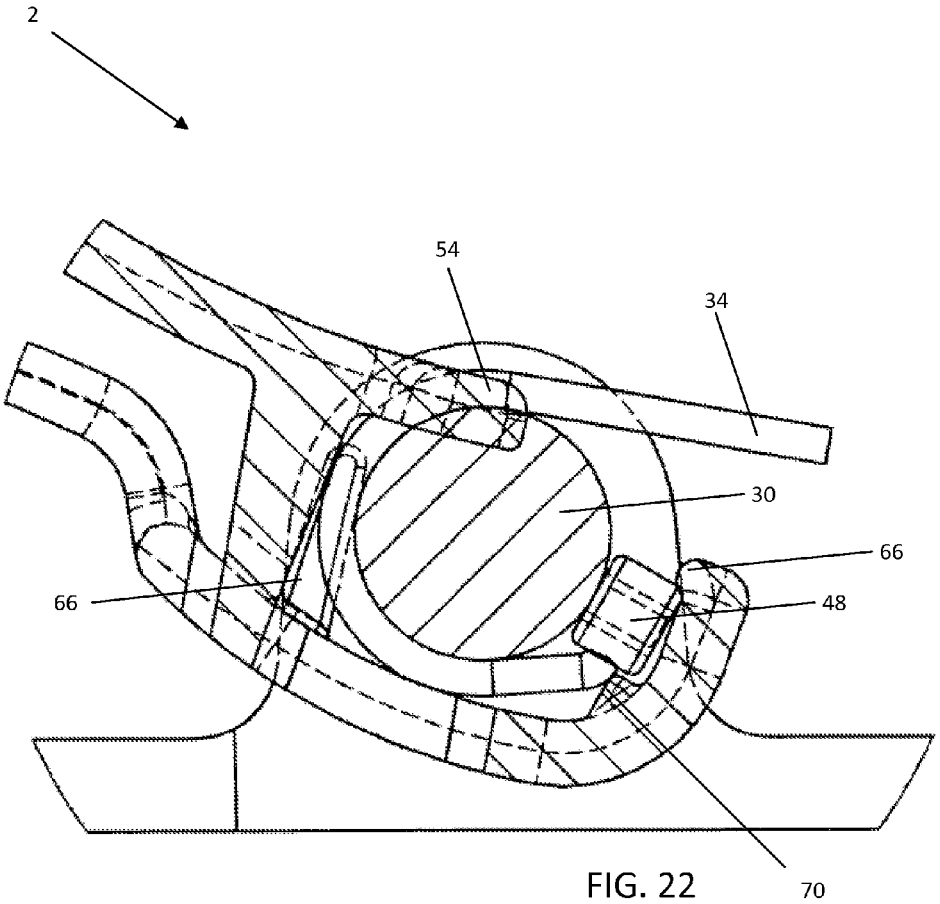
FIG. 22 is a detail view of FIG. 21 wherein the string retaining device is shown interconnected to the axle of a guitar bridge.

FIGS. 20-22 show another embodiment of a present invention wherein the head 6 includes a lower ridge 70. This embodiment also utilizes the lateral fingers 62 described above. The lower ridge 70 is designed to capture a surface of the axle that is interconnected to the guitar string which securely seats the spool 48 between the upper ridge 66 and lower ridge 70 the upper ridge and the lower ridge may span the entire width of the head 6. Alternatively, the head 6 may accommodate a series of protrusions that function as the upper or lower ridges that coincide with each string and spool position without departing from the scope of the invention.

Figure 23:
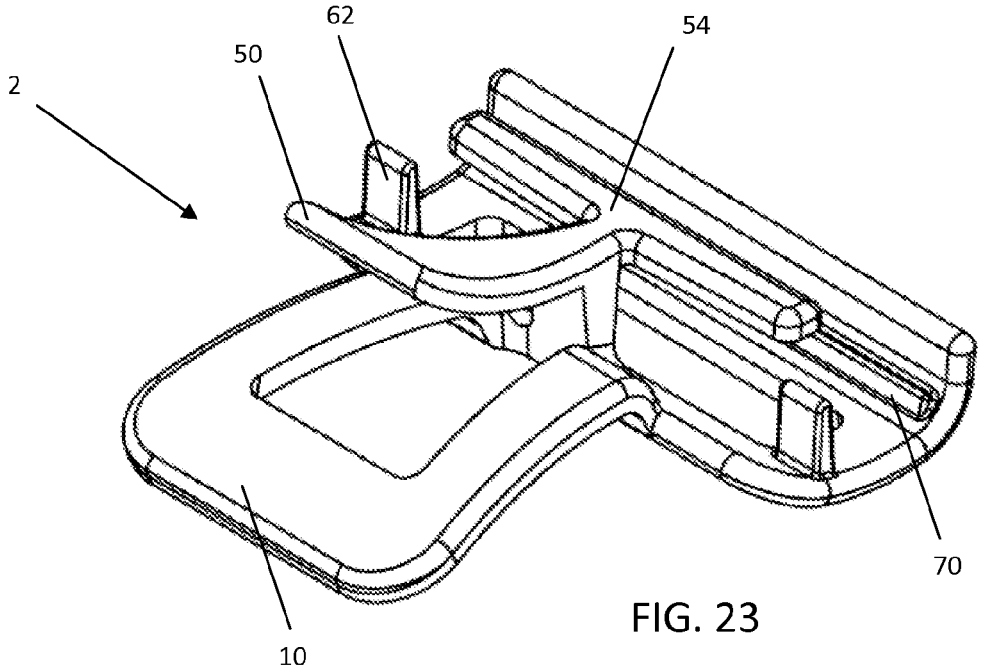
FIG. 23 is a perspective view of a string retaining device of another embodiment of the present invention.
Figure 24:
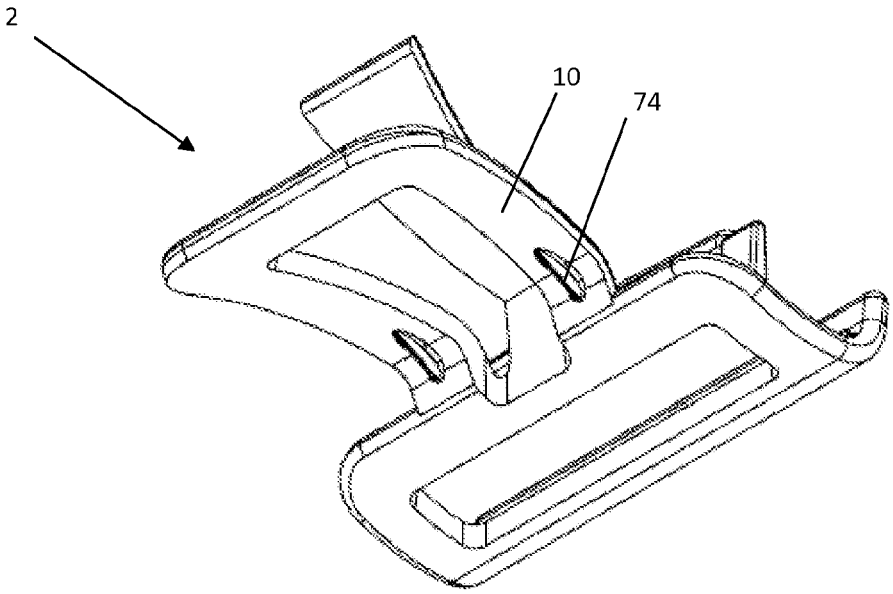
FIG. 24 is a bottom perspective view of the embodiment shown in FIG. 23.
Figure 25:
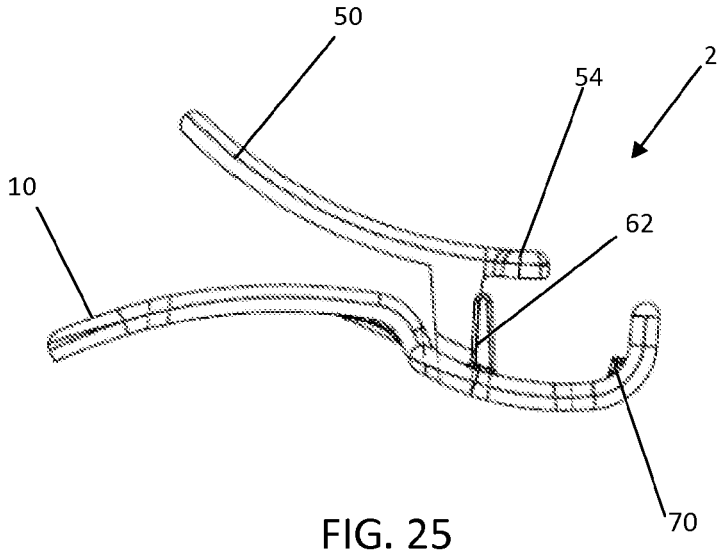
FIG. 25 is a side elevation view of the embodiment shown in FIG. 23.

Referring now to FIGS. 23-25, yet another embodiment of the present invention is shown. Here, the tab 50 includes a reinforcing member, i.e., a gusset 74 integrated into its lower surface. The gusset 50 provides additional strength, stability, and stiffness to the tab 50.

Figure 26:
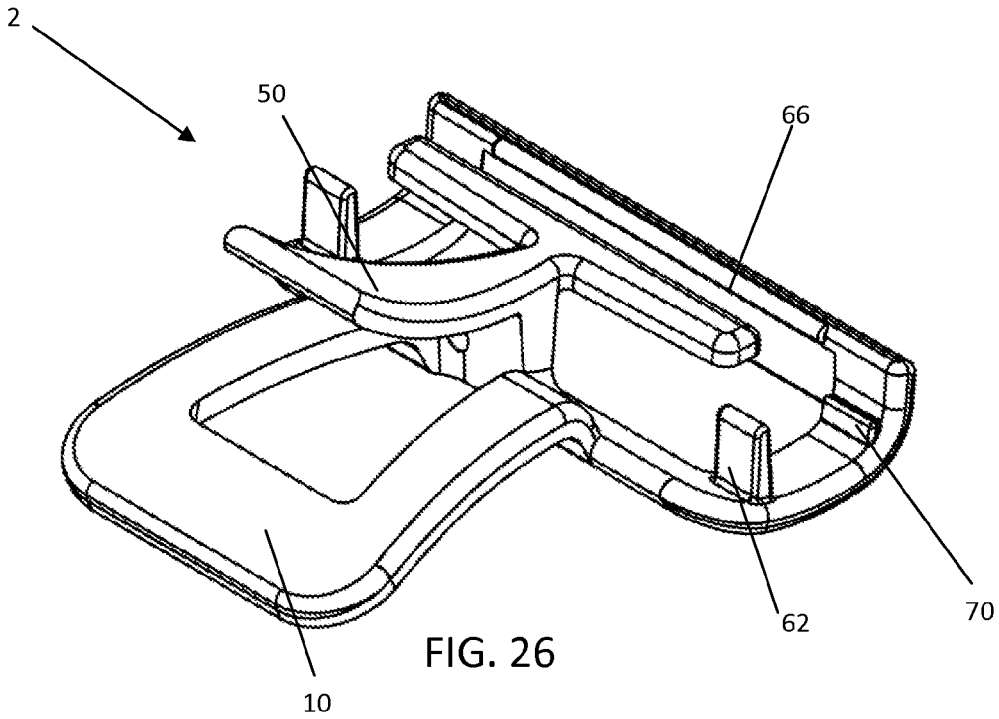
FIG. 26 is a perspective view of a string retaining device of another embodiment of the present invention.
Figure 27:
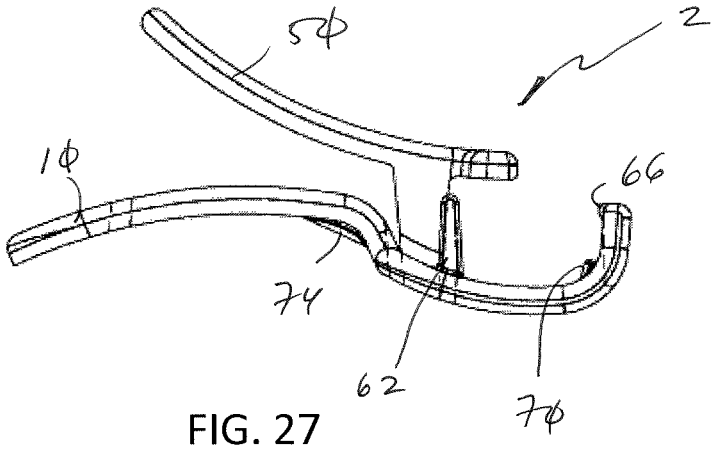
FIG. 27 is a side elevation view of FIG. 26.

FIGS. 26 and 27 show another embodiment of the present invention that is related to the embodiment shown in FIGS. 23-25 in that the tab 50 includes a gusset 74. Further, the upper ridge 66 is provided, which is similar to that described above. In addition, as briefly described above, a non-continuous lower ridge 70 is provided. The lower ridge 70 is provided adjacent to the lateral edges of the head 6 wherein only the bottom surfaces of spools associated with the first and last strings are secured. The remaining strings are retained from an upper surface of the spool by the upper ridge 66.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A device for facilitating stringing of a guitar, comprising:

a handle;

a U-shaped head having a first portion interconnected to said handle and a second portion spaced therefrom that is adapted for engagement with at least one string of the guitar, said head having a first lateral edge and a second lateral edge, a first lateral finger positioned near said first lateral edge and a second lateral finger positioned adjacent to said second lateral edge; and wherein said head is adapted to be placed under an axle of a guitar bridge with said second portion adapted to maintain the guitar string onto said axle.

2. The device of claim 1, wherein said first portion is associated with a deflectable tab, said tab having a bar that is adapted to contact a plurality of wrapped guitar strings, wherein movement of said tab moves said bar from a first position of use adjacent to said second portion to a second position away from said second portion.

3. The device of claim 1, wherein said handle is angled with respect to said head.

4. The device of claim 1, wherein said handle includes an angled portion.

5. A device for facilitating stringing of a musical instrument, comprising:

a head having a first portion interconnected to a handle and a second portion spaced therefrom that is adapted for engagement with a first end of at least one string of the musical instrument, said head having a first lateral edge and a second lateral edge, a first lateral finger positioned near said first lateral edge and a second lateral finger positioned adjacent to said second lateral edge; and a deflectable tab operably interconnected to said first portion, said tab having at least one means for engaging at least one guitar string, wherein movement of said tab moves said at least one means for engaging from a first position of use adjacent to said second portion to a second position away from said second portion.

6. The device of claim 5, wherein said head is U-shaped.

7. The device of claim 5, wherein said first portion includes at least one second means for engaging at least one guitar string.

8. A method for restringing a guitar having a bridge and a tuning peg, comprising:

providing a device having a string retaining portion spaced from a second portion that defines a channel therebetween, the second portion being interconnected to a handle;

wrapping a guitar string about an axle of the bridge;

engaging a portion of said string onto said axle;

positioning said tool under said axle such that the string retaining portion engages a portion of the string to maintain the same in engagement with the axle;

engaging a portion of the string with a lateral finger that is associated with the head; and engaging a second end of said string onto the tuning peg.

9. The method of claim 8, wherein said device includes a handle for facilitating placement of said channel underneath said axle and engaging said string retaining portion onto said portion of said string.

10. The method of claim 8, further comprising moving said handle from a first position of use to a second position of use to move said string retaining portion adjacent to a first end of said string.

11. The method of claim 8, wherein said device includes a plurality of fingers for engagement with corresponding guitar strings.

12. The method of claim 8, wherein said tool further comprises a movable tab associated with the first portion of said device, said tab having a means for holding; and further comprising deflecting said tab away from said spool contacting portion to provide a larger channel for receiving said axle; and releasing said tab to engage said means for holding against said guitar strings.

13. The method of claim 8, wherein said string retaining portion spans approximately the entire length of said axle, thereby securing a plurality of guitar strings.

14. The method of claim 8, wherein said device contacts no portion of said axle.

* * * * *